US006263617B1

(12) United States Patent
Turcot et al.

(10) Patent No.: US 6,263,617 B1
(45) Date of Patent: Jul. 24, 2001

(54) INFLATABLE SELF-ERECTING TENT

(76) Inventors: Jean-Marc Daniel Turcot; John Robert Turcot, both of 240 Clifton Road North, Kelowna, BC (CA), V1V 1N3

( * ) Notice: Subject to any disclaimer, the term of this patent is extended or adjusted under 35 U.S.C. 154(b) by 0 days.

(21) Appl. No.: 09/310,945

(22) Filed: May 13, 1999

Related U.S. Application Data

(60) Provisional application No. 60/085,623, filed on May 15, 1998, and provisional application No. 60/130,549, filed on Apr. 22, 1999.

(51) Int. Cl.[7] ..... E04B 1/34

(52) U.S. Cl. ..... 52/2.18; 52/2.11; 52/2.13

(58) Field of Search ..... 52/2.11, 2.13, 52/2.18; 135/124, 125, 126, 156

(56) References Cited

U.S. PATENT DOCUMENTS

| | | | |
|---|---|---|---|
| 2,591,829 | 4/1952 | Katzenmeyer et al. . | |
| 2,830,606 | 4/1958 | Daugherty . | |
| 3,145,719 | 8/1964 | Johnson . | |
| 3,899,853 | 8/1975 | Wertman . | |
| 3,999,333 | 12/1976 | Amarantos . | |
| 4,068,418 | 1/1978 | Masse . | |
| 4,197,681 | 4/1980 | Holcombe . | |
| 4,271,642 | 6/1981 | Karr . | |
| 4,709,718 * | 12/1987 | Nichols | 135/125 |
| 4,766,918 | 8/1988 | Odekirk . | |
| 4,819,389 | 4/1989 | Kihn . | |
| 4,825,892 | 5/1989 | Norman . | |
| 4,876,829 | 10/1989 | Mattick . | |
| 4,901,481 | 2/1990 | Seeley, Jr. . | |
| 4,918,877 | 4/1990 | Dutka . | |
| 5,005,322 | 4/1991 | Mattick et al. . | |
| 5,007,212 | 4/1991 | Fritts et al. . | |
| 5,122,400 | 6/1992 | Stewart . | |
| 5,205,086 | 4/1993 | Heim . | |
| 5,247,768 | 9/1993 | Russo . | |
| 5,421,128 | 6/1995 | Shapless et al. . | |
| 5,570,544 | 11/1996 | Hale et al. . | |
| 5,636,478 | 6/1997 | Chen . | |
| 5,987,822 * | 11/1999 | McNiff et al. | 52/2.11 |
| 6,014,982 * | 1/2000 | Strevey | 135/124 |

FOREIGN PATENT DOCUMENTS

| | | |
|---|---|---|
| 755885 | 4/1967 | (CA) . |
| 833296 | 3/1970 | (CA) . |
| 836294 | 10/1970 | (CA) . |
| 1104920 | 11/1955 | (FR) . |
| 358094 | 10/1931 | (GB) . |
| 448129 | 6/1936 | (GB) . |
| WO90/15208 | of 0000 | (WO) . |

* cited by examiner

*Primary Examiner*—Carl D. Friedman
*Assistant Examiner*—Brian E. Glessner
(74) *Attorney, Agent, or Firm*—Antony C. Edwards

(57) ABSTRACT

One or more inflatable tubes are used to support a self-erecting tent. If two or more tubes then they may have at least one cross over criss-crossed in the manner of conventional domed tent poles. The tube or tubes are secured or releasably secured to the tent so that the tent is self-erecting as the tube or tubes are inflated. When two or more tubes are employed, the tubes may be connected by an auxiliary tube so that forcing pressurized air into one tube results in all tubes inflating simultaneously. The ends of the tubes are self-sealing so as to accommodate relatively high air pressure within the tube, in the order of 20–30 pounds per square inch inflated pressure, thereby providing a significantly rigid structure from which the tent is suspended.

16 Claims, 6 Drawing Sheets

INFLATABLE SELF-ERECTING TENT

CROSS REFERENCE TO RELATED APPLICATION

This application claims priority from U.S. Provisional Patent Application No. 60/085,623 filed May 15, 1998 titled Inflatable Tent Supports, and U.S. Provisional Application No. 60/130,549 filed Apr. 22, 1999 titled Inflatable Tent II.

FIELD OF THE INVENTION

This invention relates to inflatable tent supports for erecting and supporting light weight shelters such as awnings and tents or other lightweight portable structures.

BACKGROUND OF THE INVENTION

Tents commonly utilize a semi-rigid, segmented pole. Segmented fibreglass or aluminium poles are commonly used to support, for example, dome tents.

The inflatable tent supports of the present invention overcome several difficulties associated with commonly utilized tent supporting structures. It requires no assembly prior to use. It is not normally subject to loss by being misplaced. It is easily used by those persons unfamiliar with the erecting of tents or those persons lacking sufficient strength or manual dexterity for such an undertaking and may be rapidly and easily used during inclement weather or at night.

As opposed to most other patents involving inflatable tents, there are no manifolds at the apex, or apexes instead, inflatable tubes criss-cross one another to provide for uplifting self-erecting of the tent, and once erected, to provide structural integrity to the tent. In particular, in the prior art applicant is aware of U.S. Pat. No. 5,205,086 which issued to Heim on Apr. 27, 1993 for an inflatable tent. Heim teaches a tent having a flexible canopy, floor and a series of inflatable tubes serving as frame hoops which, according to the teaching of Heim do not criss-cross in the manner of conventional domed tent supports. The tubes of Heim are fastened removably to the tent using sleeves that open along a longitudinal slit, wherein hook and loop releasable fasteners are employed for closing the sleeves onto the tubes. Each of the tubes are independently inflated and thus the tent of Heim is not self-erecting as the tubes are inflated as is the case in the present invention. The tubes of Heim are taught to be made of thermal plastics or vinyl and are the same diameter as the corresponding sleeves. Rigid boot cups are provided at the ends of the tubes for supporting the tube ends therein.

SUMMARY OF THE INVENTION

In the inflatable tent of the present invention, one or more inflatable tubes are used to support a self-erecting tent. If two or more tubes then they may have at least one cross over criss-crossed at each juncture in the manner of conventional domed tent poles. The tube or tubes are secured or releasably secured to the tent so that the tent is self-erecting as the tube or tubes are inflated. When two or more tubes are employed, the tubes are pneumatically connected by an auxiliary tube so that forcing pressurized air into one tube results in all tubes inflating simultaneously. The ends of the tubes are self-sealing so as to accommodate relatively high air pressure within the tube, in the order of 20–30 pounds per square inch inflated pressure, thereby providing a significantly rigid structure from which the tent is suspended. Advantageously, the auxiliary tube extends between the two criss-crossing tubes in airflow communication therebetween at approximately the apex of the dome shape defined by the tubes. The ends of the tubes and along the length of the tubes are attached or mounted to the tent, advantageously along corresponding seams between tent panels. The tubes may, in one embodiment, be releasably mounted onto the tent by means of releasable fasteners such as zippers. The end result is that, once the tent of the present invention has been erected, it does not need to be held up by auxiliary structures such as guy wires as is the case in the Heim teaching.

The tubes comprise an outer non-resilient sleeve containing an inner resilient bladder, for example made of rubber inner-tubes. This is not intended to be limiting as it may be reasonably foreseen to use a tubeless sleeve, where the sleeve itself is air-tight and an inner bladder is not required. The ends of the inner rubber bladder coincide with the ends of the non-resilient sleeves and are self-sealing by means of the ends of the inner-tubes being folded over onto themselves within the sleeve so that inflation of the inner-tube sandwiches the folded over end between the inflated inner-tube and the inner non-resilient surface of the sleeve. Folding over the end of inner bladder, combined with the use of conventional adhesives to seal the open ends of the bladder provides for an airtight seal even at high inflated pressure. The ends of the tubes therefore have no rigid parts which may become crushed or distorted in use as in the case of the Heim device. The rubber bladder is sewn into the sleeve so as to trap the folded over portion of the bladder within the ends of the sleeve. Increasing the air pressure within the inner-tube merely forms a stronger airtight seal at the ends of the bladder by increasing the compressive force applied to the folded over end sandwiched between the inflated bladder and the sleeve.

In the embodiment of the present invention in which the tubes are releasably mounted to the tent by means of releasable fasteners such as zippers, in the case of puncture of the bladder within a tube, that tube may be unzipped from the tent, and otherwise unfastened at its ends from the bottom corners of the tent, for example by undoing snaps or other releasable fasteners holding the ends of the tubes securely fastened to the bottom corners of the tent, and replacing the punctured tube with an identical spare tube. This may be quickly accomplished. Since tubes used to support the tent are identical, only one spare tube need be carried.

The criss-cross between the tubes at the apex of the tent support structure does not result in interference between the two tubes by reason of adjustments made to the circumferential profile of the corresponding tent seams over which the tubes pass. Whether or not the tubes pass over seams between tent panels, the circumferential portions of the tent over which the tubes pass are adjusted, by adjusting the circumferential length of segments of the corresponding circumferential profiles so that one tube crosses over the apex at higher point than the other tube.

Thus, in one preferred embodiment, first and second criss-crossing inflatable tubes are mounted or mountable to corresponding criss-crossing first and second circumferential profiles wherein the first and second circumferential profiles may correspond to the seams between tent panels making up the tent. In any event, the first and second circumferential profiles are differently shaped when view in cross-section in first and second corresponding planes containing correspondingly the first and second circumferential profiles, the first circumferential profile having a shorter circumferential distance than the second circumferential profile. Thus, when the first and second tubes are mounted along their corresponding first and second circumferential profiles along segments of those profiles not including segments at the apex of the tent, and in view of the fact that both the first and second tubes are identical in length, the first tube forms an arch at the apex of the tent which extends a higher vertical distance above the tent apex than does the corresponding portion of the second tube. The first tube therefore crosses over the second tube at the apex of the tent by reason of its higher arched profile.

DETAILED DESCRIPTION OF THE PREFERRED EMBODIMENT

Figure 1:
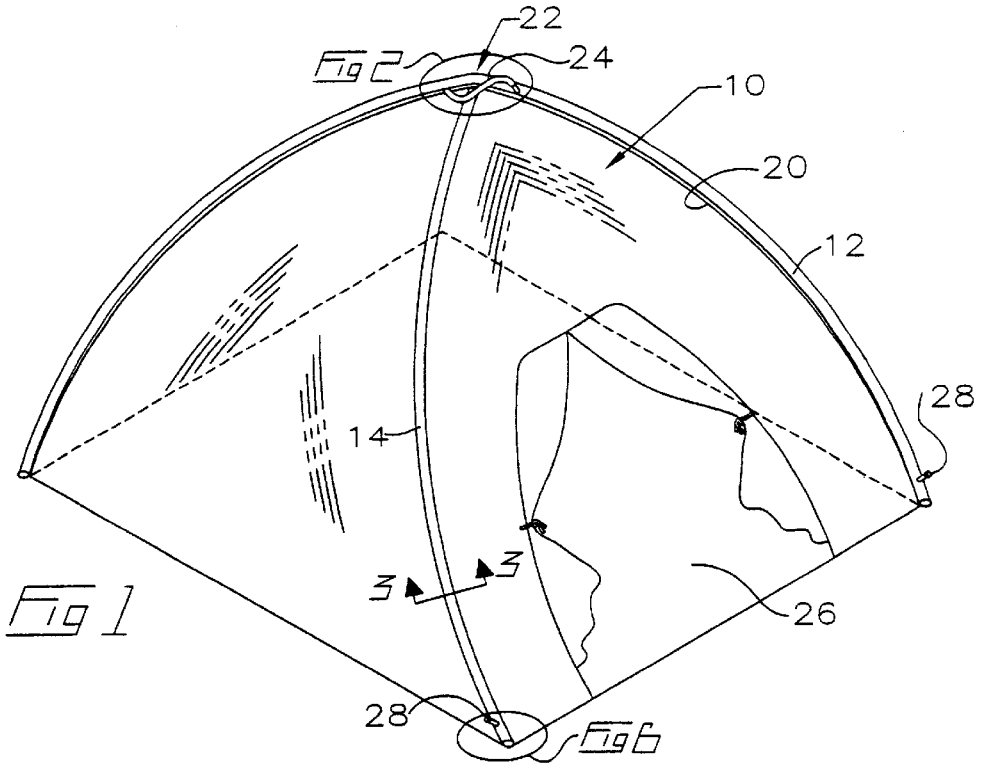
FIG. 1 is, in perspective view, one embodiment of the inflatable tent of the present invention.
Figure 1A:
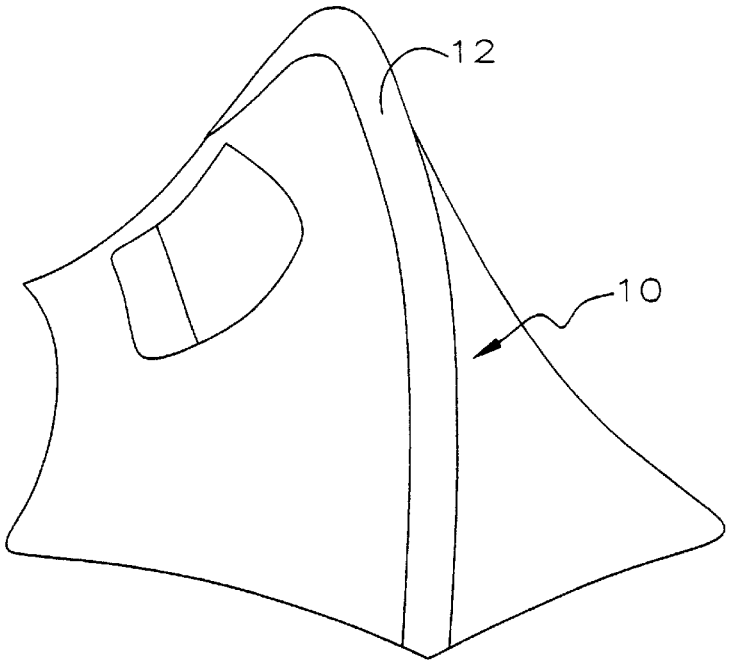
FIG. 1*a* is, in perspective view, a single tube embodiment of the present invention.

FIG. 1 is a perspective view of a typical dome-style tent incorporating the present invention, with the tent's, fly removed for clarity. FIG. 1*a* is a perspective view of an inflatable self-erecting tent according to the present invention wherein only one inflatable tube is used, the result being a modified "pup" tent. The pup tent is self-erecting, once the ground edges or corners are pegged to the ground, by inflating the single tube which extends from opposite edges.

Figure 7:
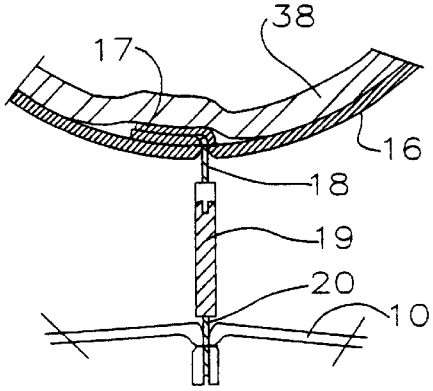
FIG. 7 is, in partially cut-away cross-sectional view, an enlarged portion of the view of FIG. 6.

Inflatable tent supports are illustrated in use with both dome-type tent 10 and the pup tent. In FIG. 1 the inflatable tent supports comprise identical intersecting elongate inflatable tubes 12 and 14. One such tube is used in the embodiment pup tent of FIG. 1*a*. The tubes are sealed at their ends and each is enclosed within a non-resilient fabric sleeve 16 as better seen in FIGS. 2 and 3. Each sleeve 16 may be formed by sewing a rectangular piece of material into a straight sleeve having a folded-over or foldable overlapping seam 17 as seen in FIG. 7. Folding over of the seam within an inverted sleeve allows for ease of bending of the combination sleeve and tube once inflated, to conform to the shape of the tent canopy. Each sleeve 16 is also closed at its terminal ends. The sleeve may in one embodiment be formed as an integral part of the tent fabric during manufacture of the tent, however, when retrofitting to existing tent structures, a projecting flexible flange or seam 18 is left on one side of the sleeve so that it may be sewn or releasably mounted by zippers 19 to a corresponding flexible flange or seam 20 on the side of the tent.

In the illustrated example, the inflatable tubes cross at the apex 22 of the tent. A pneumatic airway connection is provided between both tubes by a flexible connecting tube 24 of smaller diameter. Stem 28 advantageously located near a corner of tent 10 or near the access door 26, or any other easily accessible location contains a one-way valve 30 and projects from each inflatable tube through the fabric of sleeve 16 for inflation of the tubes. When two or more tubes are used, the inner core of a second valve stem is removed so that by removing the valve stem cap, air is allowed to escape thereby releasing the air pressure and deflating the tubes when taking down the tent.

Tubes 12 and 14 are advantageously identical so that only a single replacement or spare tube need be carried. Tubes 12 and 14, once mounted onto the tent, may be inflated from the one valve 30. The tubes are inflated by way of a hand pump, or compressed air (for example from a portable tank), or compressor or $CO_2$ cartridges or the like. The tent is self-erecting, that is, may be erected without additional effort other than inflation of the tube reservoir. As the air pressure in the tubes is increased, the tubes attempt to straighten out. They are constrained by the shape of their corresponding profiles, the profiles themselves defined by the corresponding tensioned shape of the tent or tent panels along seam 20.

Figure 1B:
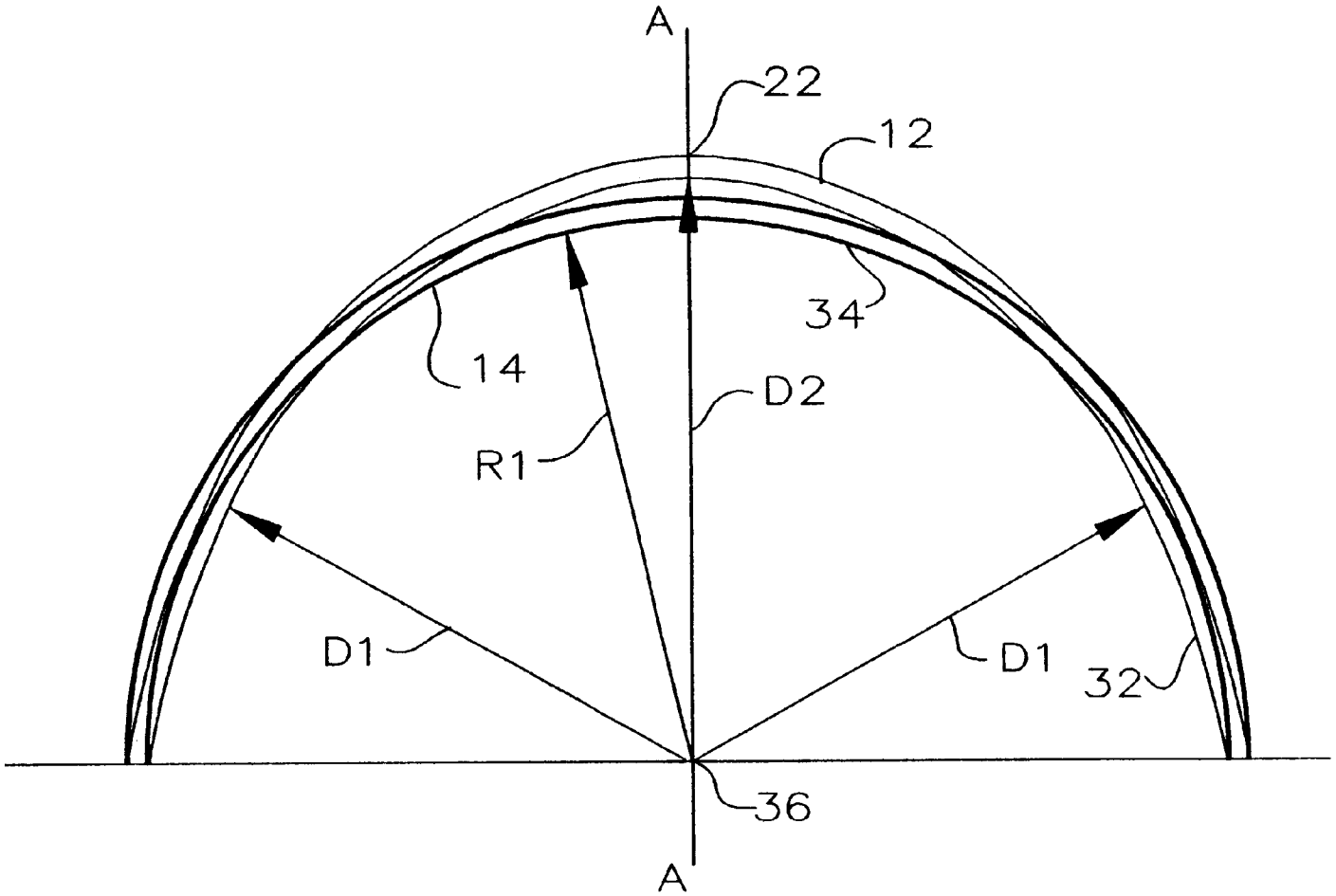
FIG. 1*b* is, in elevation view, the embodiment of FIG. 1 showing arched tube profiles overlaid.

The tent canopy profiles, in cross-section namely tent profiles 32 and 34, define the curvature respectively of tubes 12 and 14 as seen in FIG. 1*b*. In FIG. 1*b* cross sections along each profile and corresponding tube in FIG. 1 are overlaid for ease of comparison. Thus it may be seen that profile 34 may for example approximate a semi-circle having constant radius R1. In this case, in order to cross tube 12 over tube 14 at apex 22, keeping in mind that tubes 12 and 14 are identical in length, shape and construction, profile 32 is not of contant radius but rather has side profile distances D1 (measured from common centroid 36) which are less than radius R1 so that tube 12 is forced upwardly into an arch having a vertical distance D2 above centroid 36 at apex 22.

With tubes 12 and 14 secured to seams 20, and seams 20 tailored, to define profiles 32 and 30 whether by adapting a conventional symmetrically domed tent by additional stitching or the like, or by manufacturing tent 10 with seams 20 already tailored, to force the tubes into profiles 32 and 34 respectively, as the tubes are inflated through one of the valves 30 to 20–30 pounds pressure, the criss-crossed tubes support one another and constrain the direction of bowing of the tubes generally along centroidal axis A. Tent 10 is thus self-erecting and self-stabilizing as it is erected, that is, as apex 22 is elevated upwardly along axis A, urged by the uplifting forces resultant of the criss-crossed tubes being inflated and the uplifting urging resultant of the design of the ends of the tubes as better described below.

When maximum inflation is achieved the tubes are held in relatively stable crossed juxtaposition to support the tent.

Figure 2:
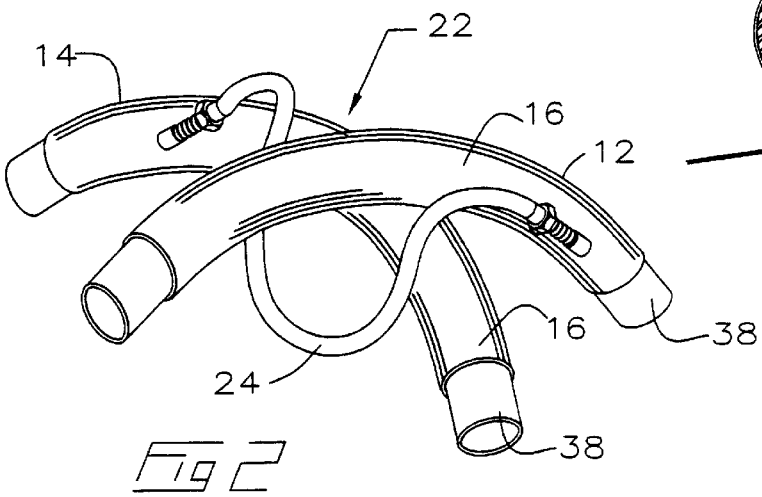
FIG. 2 is a partially cut-away enlarged view of a portion of FIG. 1.
Figure 3:
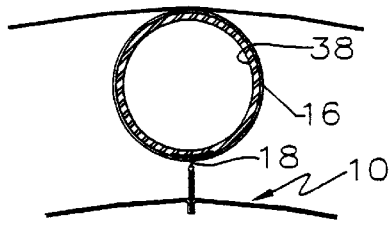
FIG. 3 is a cross-sectional view along line 3—3 in FIG. 1.
Figure 4:
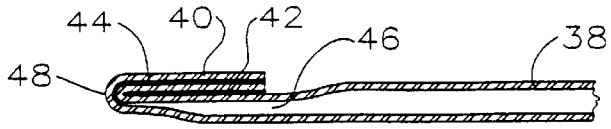
FIG. 4 partially cut-away cross-sectional view along an end of a resilient tube bladder according to the present invention.

As seen in FIGS. 2 and 3, sleeve 16, which are non-resilient, advantageously made of fabric or the like, contain snugly therein resilient tubes 38. Resilient tubes 38 may be made of rubber. As better seen in FIG. 4, the ends of resilient tubes 38 have a folded section 40 folded over and laid back against the adjacent portion of the resilient tube and secured thereto by adhesive layer 42. An adhesive layer 44 adheres the sides of the tube forming folded section 40 together. Cavity 46 within resilient tubes 38 thus extends along side folded section 40 and terminates at fold line 48.

Figure 6A:
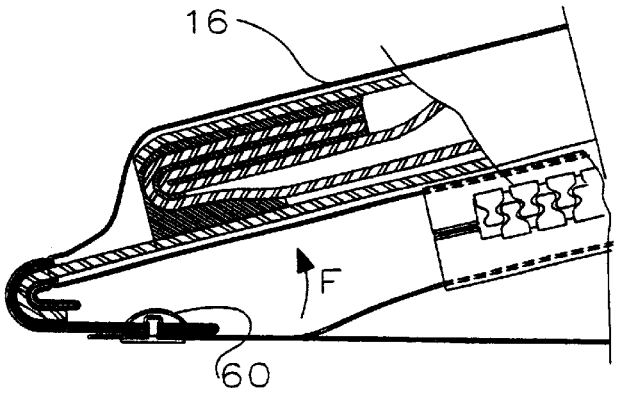
FIG. 6*a* is the view of showing self-erecting movement during inflation of a tube.
Figure 5:
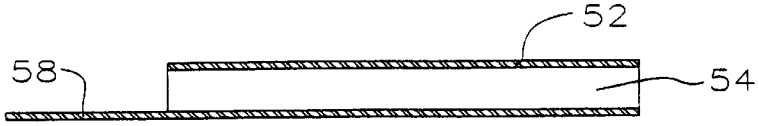
FIG. 5 is, in partially cut-away cross-sectional view, an end of the non-resilient tube sleeve of the present invention.
Figure 6:
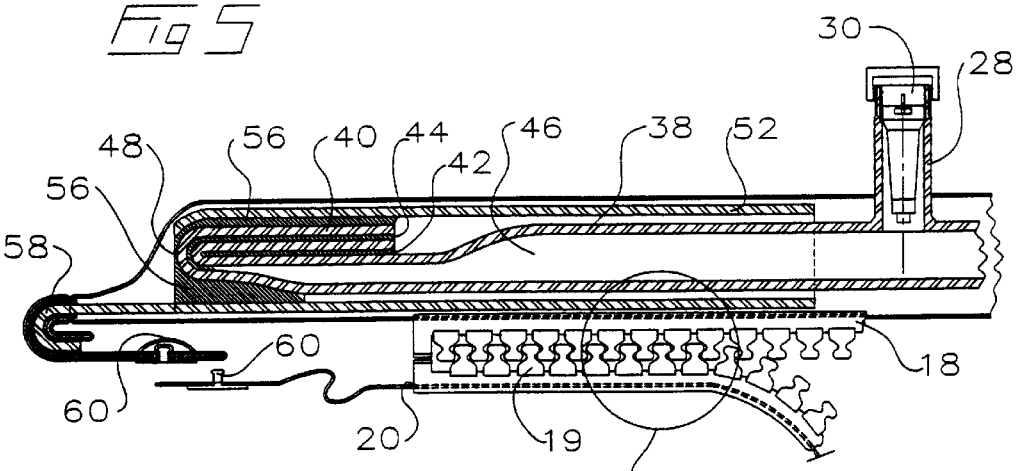
FIG. 6 is, in partially cut-away cross-sectional view, an enlarged portion of the view of FIG. 1.

The ends of resilient tubes 38 above described, are positioned within corresponding ends of sleeves 16, one of which is better depicted in FIG. 6. As seen in FIGS. 5 and 6, in one preferred embodiment, a resilient cylindrical boot 52 is used to encapsulate the end of resilient tube 38 and folded section 40 within tubular cavity 54. The end of resilient tube 38 adjacent folded section 40, and folded section 40 are secured within tubular cavity 54 by adhesive layer 56, where it is understood that adhesive layers 42, 44 and 56 are of an appropriate adhesive which remains resilient when cured.

Resilient boot 52 may have extending from an end thereof a resilient flange 58 which serves to anchor resilient boot 52 within the end of sleeve 16 by sandwiching resilient flange 58 between the stitched closed end of sleeve 16. As better seen in FIG. 6, the end of sleeve 16 may be stitched closed and folded over so as to be releasably secured to a corner of tent 10 by means of releasable fasteners such as the button snap 60 illustrated.

The above described inflatable supports may thus exhibit an important characteristic, namely, that when inflation begins, as air flow reaches the ends of the supports, the result is an uplifting. Since the ends are sealed and air pressure is introduced, and since the bottom part of the sleeve is secured to the tent floor at the very end, the sleeve, as it begins to inflate, begins to push against the pegged tent floor as seen in FIG. 6*a,* and by so pushing urges the inflatable support upwardly so as to assist in self-erecting of the tent. The more air pressure is added, the more force "F" helps the tent to self-erect. Further, the greater the maximum air pressure, the greater the rigidity of the tent structure. Since the design of the rubber bladder is made so that the end of the supports become stronger with more pressure, the uppermost limit of the air pressure that the inflatable support will sustain is primarily only limited by the tensile strength of the sleeve material, rather than the pressure at which the sealed ends of the inflatable tube will fail.

Advantageously the tent may be pegged to the ground at its corners.

Figure 8:
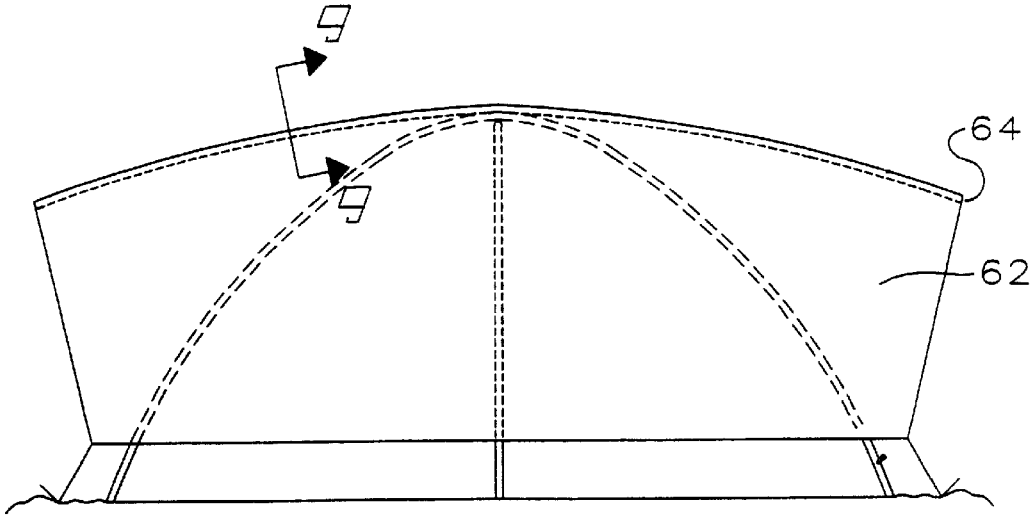
FIG. 8 is, in inside elevation view, an alternative use of an inflatable tube according to the present i n for suspending a tent fly above a tent.
Figure 9:
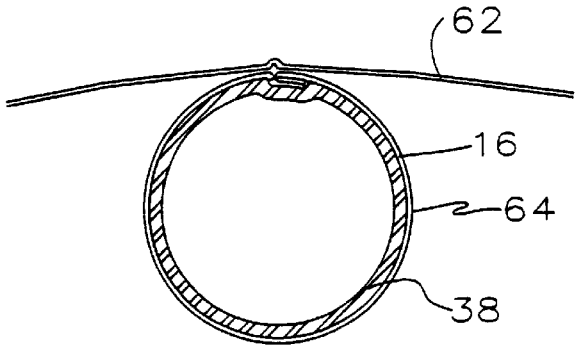
FIG. 9 is a cross-sectional view along line 9—9 in FIG. 8.
Figure 10:
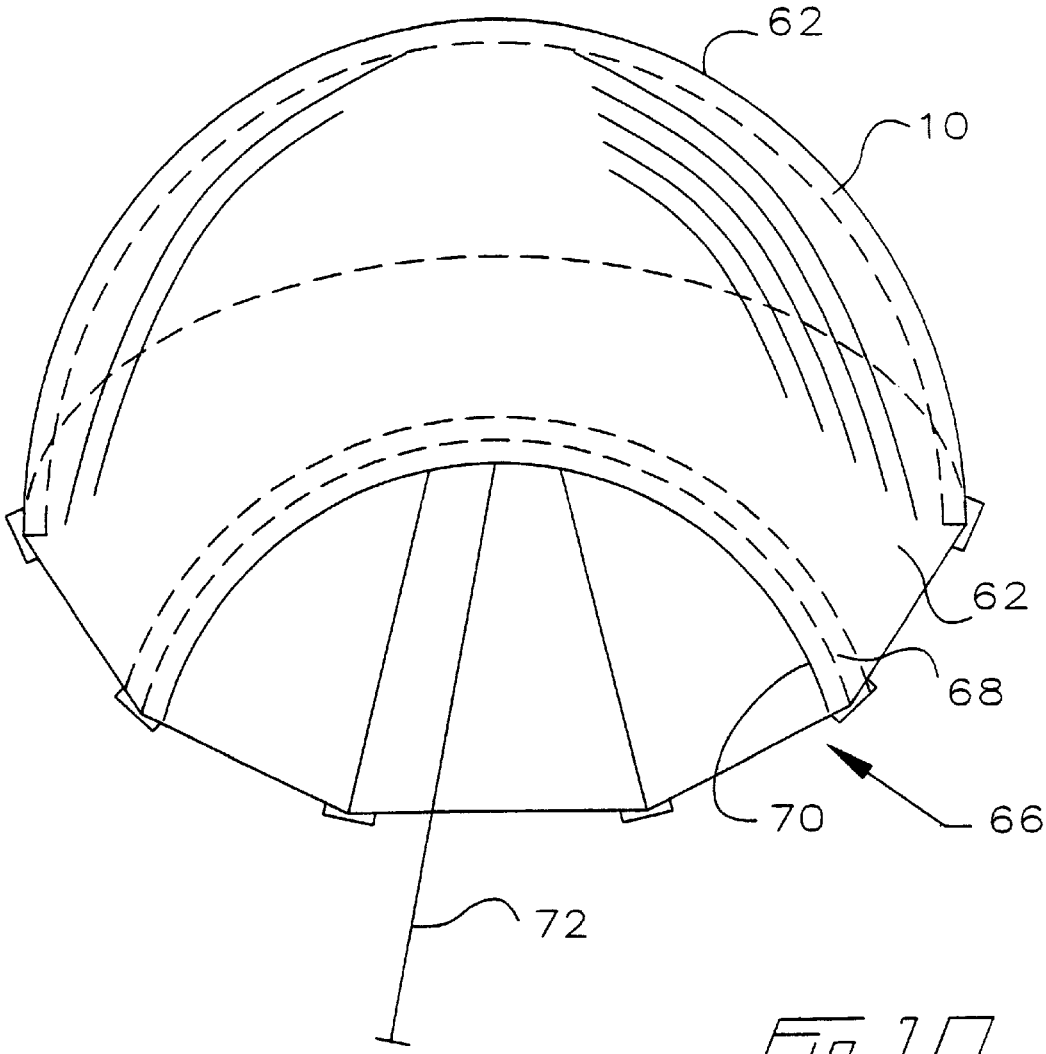
FIG. 10 is, in perspective view, an alternative embodiment wherein a vestibule tube supports a vestibule.

FIGS. 8 and 9 illustrate an inflatable tent fly 62 over tubes 12 and 14 and tent 10. A single inflatable tube 64, identical in construction to tubes 12 and 14 is fastened at about its mid-length to fly 62 or to tube 12 at apex 22. When inflated, tube 64 rises at both ends, thereby facilitating entry into the tent while providing an air space which, in turn, allows a free flow of air between the tent wall and the fly, just as it does with conventional rigid tent poles. The corners of the fly may be attached to the tent corners, just as they are with conventional rigid tent poles, or otherwise secured to the ground by lines or pegs. As seen in FIG. 10, the fly 62 may be modified to provide a vestibule extension 66. Vestibule 66 may be supported by an inflatable auxiliary vestibule tube 68 shown in dotted outline. Vestibule tube 68 extends around a vestibule doorway 70 and may be supported upright by means of mounting to a tube 64 or the like or by means of a conventional pegged guy wire 72.

In the preferred embodiment, each tube 38 is an elongate unitary resilient tube. In a further embodiment resilient tubes 38 may be bicycle inner tubes such as readily available 28 inch diameter by 2.125 inch cross section bicycle inner tubes. These inner tubes are cut so as to form an elongated length when straightened. A plurality of such tubes may be joined end to end by resilient adhesive. Thus may be formed tubes 12 and 14 having no rigid components. In a typical 7 foot by 7 foot (or 8 feet by 8 feet, etcetera) tent structure, using two inflatable supports, five bicycle tubes will be required to form the two tubes 12 and 14, that is, 2½ bicycle tubes per inflatable pole. In forming the tubes using the bicycle inner tubes, the inner tubes, once cut and straightened, are overlapped at their ends and glued by using an inner form or block (not shown) slid snugly into the ends of the inner tubes. The form or block, which may be advantageously cylindrical in shape, provides a bearing surface against which the inner tube material presses until the adhesive sets so as to form a seal around the ends of the adjacent bicycle inner tube.

As will be apparent to those skilled in the art in the light of the foregoing disclosure, many alterations and modifications are possible in the practice of this invention without departing from the spirit or scope thereof Accordingly, the scope of the invention is to be construed in accordance with the substance defined by the following claims.

What is claimed is:

1. An inflatable self-erecting tent system having a tent canopy, said tent comprising:

when erect, substantially vertical circumferential first and second profiles on said tent canopy, said profiles intersecting, at corresponding first and second vertices thereof, a common vertical axis, said first and second profiles radially spaced apart about said common vertical axis, a first inflatable support mountable to said first profile so as to form an arch as defined by a circumferential shape of said first profile, a second inflatable support mountable to said second profile so as to pass under said arched first inflatable tube as defined by a circumferential shape of said second profile, wherein said first and second profiles extend circumferentially over said tent canopy from opposite ground engaging edges of said canopy, and wherein said first and second profiles have corresponding circumferential first and second distances and wherein said first and second inflatable supports inflatable supports are of substantially the same length, and wherein said first and second distances are substantially the same, wherein said first and second inflatable supports comprise inner resilient tubes snugly mountable within outer non-resilient straight sleeves in journalled relation therethrough, wherein each sleeve of said outer non-resilient straight sleeves has a seam extending linearly along its length, each said seam in opposed facing relation to said first and second profiles of said canopy when said first and second inflatable supports are mounted to said first and second profiles respectively, each said seam being an overlapped seam having an overlapped portion within said sleeve due to inversion of said sleeve following forming of said scam, said overlapped portion formed of the longitudinal edges of material forming said sleeve, said overlapped portion folded over so as to be disposed perpendicular to a curvature of said seam when said inflatable supports are inflated.

2. The tent system of claim 1 wherein said first and second inflatable supports are, when mounted to said canopy along said first and second profiles, pneumatically interconnected by a flexible air conduit extending therebetween.

3. The tent system of claim 2 wherein said first and second inflatable supports are self-sealing by self-sealing means at ends of said first and second supports, said self-sealing means comprising ends of said inner resilient tubes which are folded over onto themselves, said ends of said tubes anchored by anchoring means to said ends of said first and second supports, said ends of said first and second supports each formed as a flap hinge when said ends are mounted to said tent canopy.

4. The tent system of claim 1 wherein said inner resilient tubes are adapted, when mounted in said sleeves, to contain air pressurized to approximately 20 pounds per square inch.

5. The tent system of claim 1 wherein said first profile is an arch and said second profile approximates a semi-circle.

6. The tent system of claim 1 wherein said first and second supports are mountable by releasable fasteners to said first and second profiles.

7. The tent system of claim 1 further comprising an inflatable vestibule support mountable around an opening aperture of a tent vestibule of said tent canopy.

8. An inflatable self-erecting tent having a tent canopy, said tent comprising:

when erect, substantially vertical circumferential first and second profiles on said tent canopy, said profiles intersecting, at corresponding first and second vertices thereof, a common vertical axis, said first and second profiles radially spaced apart about said common vertical axis, a first inflatable support mounted to said first profile, a second inflatable support mounted to said second profile, wherein said first and second profiles extend circumferentially over said tent canopy from opposite ground engaging edges of said canopy, wherein said first and second inflatable supports comprise inner resilient tubes snugly mounted within outer non-resilient straight sleeves in journalled relation therethrough, wherein each sleeve of said outer non-resilient straight sleeves has a scam extending linearly along its length, each said seam in opposed facing relation to said first and second profiles of said canopy, each said seam being an overlapped scam having an overlapped portion within said sleeve due to inversion of said sleeve following forming of said seam, said overlapped portion formed of the longitudinal edges of material foaming said sleeve, said overlapped portion folded over so as to be disposed perpendicular to a curvature of said scam when said inflatable supports are inflated.

9. The tent of claim 8 wherein said first and second inflatable supports are, pneumatically interconnected by a flexible air conduit extending therebetween.

10. The tent of claim 9 wherein said first and second inflatable supports are self-sealing by self-sealing means at ends of said first and second supports, said self-sealing means comprising ends of said inner resilient tubes which are folded over onto themselves, said ends of said tubes anchored by anchoring means to said ends of said first and second supports, said ends of said first and second supports each formed as a flap hinge when said ends are mounted to said tent canopy.

11. The tent of claim 8 wherein said inner resilient tubes are adapted, when mounted in said sleeves, to contain air pressurized to approximately 20 pounds per square inch.

12. The tent of claim 8 wherein said first profile is an arch and said second profile approximates a semi-circle.

13. The tent of claim 8 wherein said first and second tubes are mounted by releasable fasteners to said first and second profiles.

14. The tent of claim 8 further comprising an inflatable vestibule support mounted around an opening aperture of a tent vestibule of said tent canopy.

15. An inflatable, pegged, self-erecting tent comprising an inflatable support mounted to a canopy of said tent along a ridge-line thereof, said canopy having circumferential ground-engaging edges adapted for pegged anchoring of said edges to a ground surface, said ridge-line extending over said canopy from one of said edges to an opposite edge of said edges, wherein said inflatable support comprises an inner resilient tube snugly mounted within an outer non-resilient straight sleeve, wherein said sleeve of said outer non-resilient straight sleeve has a seam extending linearly along its length, said seam in opposed facing relation to said ridge-line of said canopy, said seam being an overlapped seam having an overlapped portion within said sleeve due to inversion of said sleeve following forming of said seam, said overlapped portion formed of the longitudinal edges of material forming said sleeve, said overlapped portion folded over so as to be disposed perpendicular to a curvature of said scam when said inflatable support is inflated.

16. The tent of claim 15 wherein each end of said tube has a flexible flap hinge mounted thereto oriented so that a lower flap, mounted to a base of said canopy, of said flap hinge is disposed below and adjacent said each end of said tube and is directed inwardly of said flap hinge, towards a center of said tent, whereby inflation of said tube urges rotation of said each end of said tube upwardly about said flap hinge relative to said lower flap.

* * * * *